United States Patent [19]

Kitchell

[11] 4,375,261

[45] Mar. 1, 1983

[54] PAD AND BLANK THEREFOR TO SUPPORT AN OBJECT IN A SHIPPING CONTAINER

[75] Inventor: Thorne C. Kitchell, Spartanburg, S.C.

[73] Assignee: Union Camp Corporation, Wayne, N.J.

[21] Appl. No.: 243,722

[22] Filed: Mar. 16, 1981

[51] Int. Cl.[3] ..... B65D 85/00; B65D 81/02

[52] U.S. Cl. ..... 206/320; 206/592; 220/441

[58] Field of Search ..... 206/45.14, 45.19, 320, 206/482, 486, 487, 488, 489, 585, 586, 591, 592, 593, 594, 814; 220/415, 441; 229/23 A

[56] References Cited

U.S. PATENT DOCUMENTS

| | | | |
|---|---|---|---|
| 1,156,074 | 10/1915 | Hahn | 206/482 |
| 2,163,045 | 6/1939 | Lavere | 206/592 |
| 2,783,930 | 3/1957 | Riley | 206/521 |
| 2,895,661 | 7/1959 | Budd | 206/586 |
| 2,936,880 | 5/1960 | Kohlhaas | 206/320 |
| 3,107,780 | 10/1963 | Stuckert | 206/320 |
| 3,159,273 | 12/1964 | Schecterson et al. | 206/45.19 |

*Primary Examiner*—William Price
*Assistant Examiner*—Jimmy G. Foster
*Attorney, Agent, or Firm*—Kane, Dalsimer, Kane, Sullivan and Kurucz

[57] ABSTRACT

This disclosure is of a paperboard pad for insertion in a shipping container having a die cut panel to provide spaced stop-support assemblies positioned in the contour of the end of the object being shipped in the container, which assemblies provide stops held normal to the die cut panel by bracing members to support the said end.

7 Claims, 6 Drawing Figures

PAD AND BLANK THEREFOR TO SUPPORT AN OBJECT IN A SHIPPING CONTAINER

BACKGROUND OF THE INVENTION

1. Field of the Invention

The invention relates to pads for insertion in shipping containers and more particularly to a paperboard pad having a die cut panel to provide spaced stop-supports positioned in the contour of the ends of the object being shipped in the container.

2. Brief Description of the Prior Art

The pad of the present invention was initially designed to support the bottom of a water heater in a shipping container. Heretofore a three thickness die cut pad had been used to support the bottom of such water heater in a shipping container. Such three thickness pad did not prevent the heater from moving within the container. Furthermore, such pad used one third more corrugated board than the pad of the present invention. To support the top of the water heater a metal plate with a hole in the middle was glued between two plies of a pad. A plug was screwed through the plate and pad into a fitting at the top of the heater. This centered and secured the heater in the container.

The pad of the present invention can be used for both the top and bottom of the water heater. By using such pad for the top it is possible to eliminate both the plug and the metal plate.

Furthermore, it has been found that the pad of the present invention can be used not only for a cylindrical object, such as a water heater, but for objects having ends of virtually any shape. This is accomplished by spacing the stop-support assemblies in desired locations around the die cut pad so that the stops will be positioned in the contour of the end of the object being shipped in the container.

SUMMARY OF THE INVENTION

The invention comprises a pad to support an object in a shipping container comprising:

a panel, sized substantially the same as the inner dimensions of the said container and positioned to contact an end of said object, being die cut to provide a plurality of spaced stop-support assemblies having stops placed to contact the edge of the said end around its contour;

each said assembly comprising:

a stop hinged to the die cut panel and folded normal thereto;

a bracing member hinged to and folded outwardly away from the said stop;

the said bracing member being shaped so that each of one or more edges opposite the hinge to the stop will be aligned with the edge of the die cut panel; and means to secure the side of the bracing member opposite its said hinge to the die cut panel;

whereby the bracing member, secured to the die cut panel and reinforced from moving outwardly by at least one inner side of the container, will lock the stop in a position normal to the die cut panel.

DETAILED DESCRIPTION OF THE PREFERRED EMBODIMENT OF THE INVENTION

Figure 1:
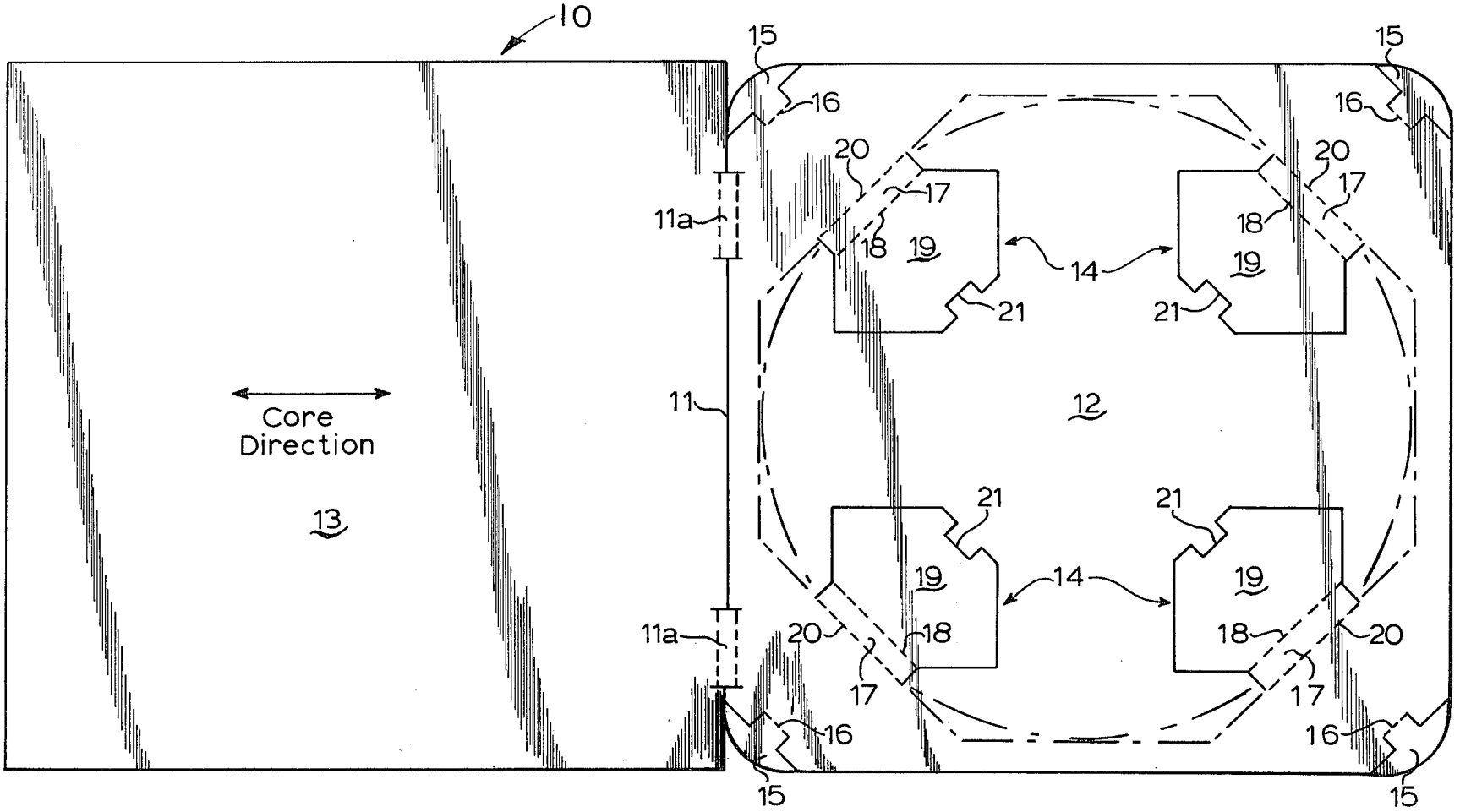
FIG. 1 is a plan view of the blank from which the pad of the present invention, with an additional supporting panel, can be formed for use with an object having a cylindrical or similar end.

Referring to the drawings, there is shown in FIG. 1 a flat blank 10 of sheet material, such as corrugated board or the like, of a weight suitable for the size and weight of the object to be supported by the pad. The blank has been scored and cut along line 11 to provide two panels 12 and 13 of substantially equal size connected by two hinges 11*a*. The blank can be folded on line 11 so that the two panels will be super-imposed to provide a two thickness pad.

The panel 12 is die cut to provide a plurality of stop-support assemblies 14. Such assemblies each comprise a T-shaped locking member 15 with a score line 16 at its base so that such member 15 can be folded along the score line 16 to a position normal to panel 12. The assembly also comprises a rectangular stop 17 connected along a first score line 18 to a bracing member 19. The stop 17 and bracing member 19 are completely cut from the panel 12 except for a second score line 20 spaced from and parallel to the first score line 18. The bracing member 19 is provided with a slot 21 at its inner edge 21*a* which is adapted to fit into the stem of the T-shaped locking member 15. The bracing member is shown as a rectangle with triangles at each end. The significance of this shape will be explained hereinafter. If such bracing member is considered as a rectangle, the edge 21*a* containing the slot 21 and the first score line 18 should be generally parallel. The bracing member 19 is shaped and of a width so that, when the stop is erected normal to the panel, the angular edges 21*b* and 21*c* opposite the hinge to the stop will extend to the outside edges of the panel.

Figure 2:
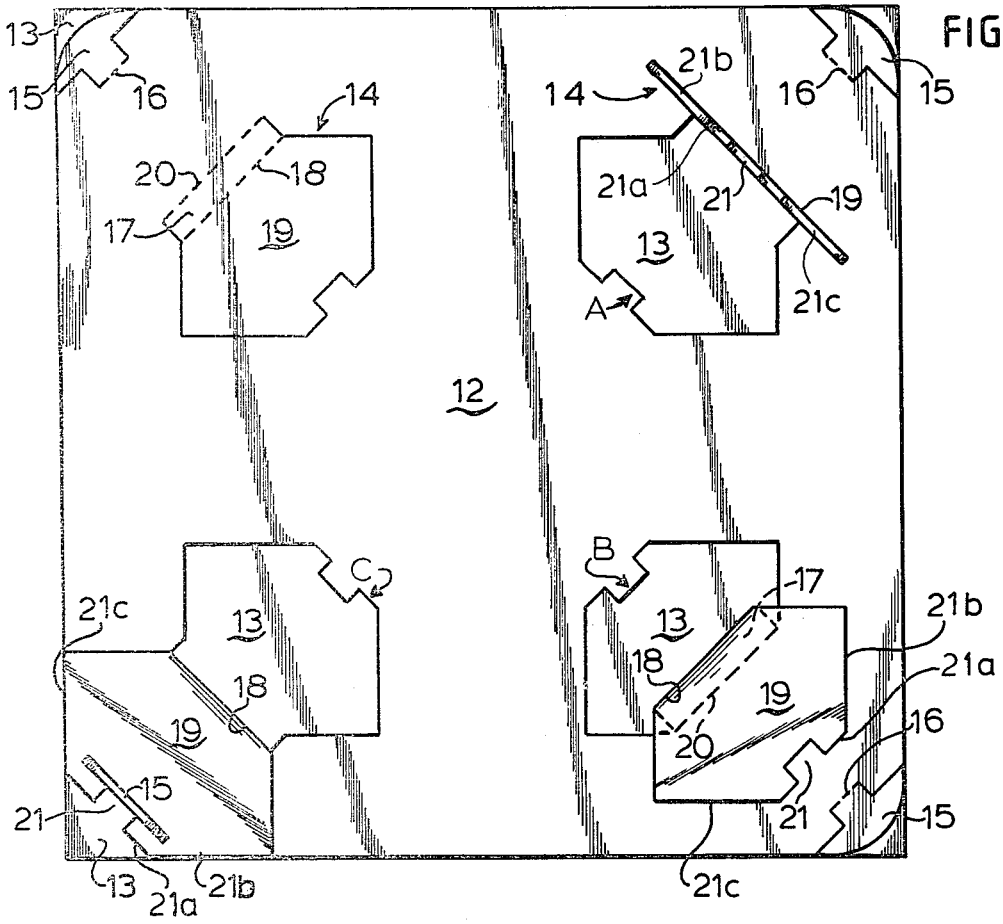
FIG. 2 is a plan view showing the panels of the blank of FIG. 1 superimposed and the stop-support assemblies in various stages of folding.
Figure 3:
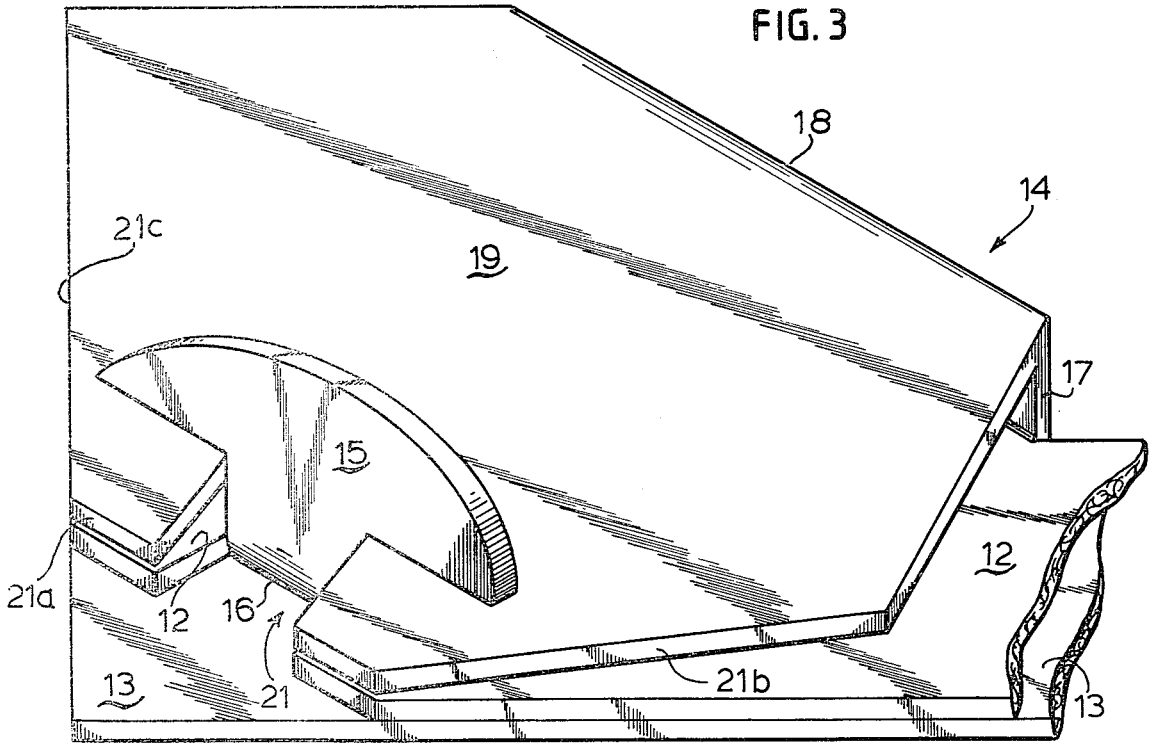
FIG. 3 is a perspective view of one of the stop-support assemblies with the stop folded normal to the panel and the bracing member locked in a fixed position.
Figure 4:
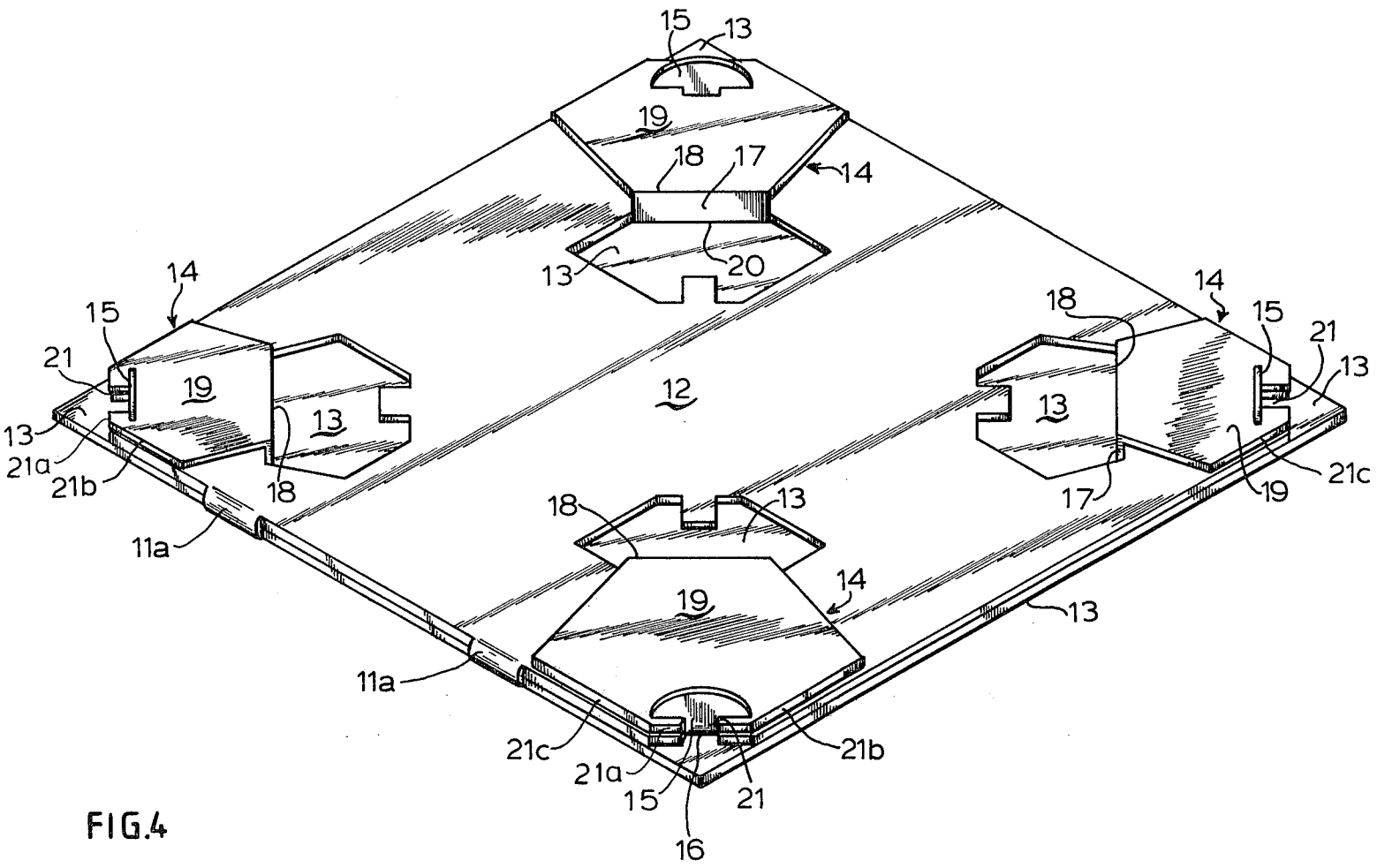
FIG. 4 is a perspective view of the pad with all of the stop-support assemblies erected ready to receive an object with a generally cylindrical end.

FIG. 2 shows the panel 12 with the stop-support assemblies in various stages of folding designated by the letters A, B and C. The stop 17 of each assembly is adapted to be folded upwardly normal to the panel 12 along the second score line 20 (FIG. 2-A). The bracing member is then folded toward the adjacent locking member 15 along the first score line 18 (FIG. 2-B), the slot 21 is inserted into the stem of the T-shaped locking member 15 as the locking member 15 is raised to secure the bracing member 19 in a fixed position (FIG. 2-C; FIG. 3). The support assemblies 14 are positioned on the panel 12 so that the stops 17 are each along the circumference of a circle or the contour of a figure of similar shape (octagon) with the center in the middle of the panel 17. In FIG. 1 the dotted lines on the die cut panel show one contour for an object with a cylindrical end and another contour for an object with an octagonal end. The bracing members 19 are shaped as illustrated in FIG. 1 when each such member is to be folded over a corner of the panel 12. When the bracing members are locked in position the edges 21*b* and 21*c* are superimposed over and aligned with the outside edges of the pad panel 12. This is important because such edges 21*b* and 21*c* resting against the inside faces of the shipping container will reinforce the bracing member against moving outwardly and thus further lock the stop in a position normal to the panel (FIG. 3).

The four stops 17 spaced around a circle will provide supports against the top or bottom edges of a cylindrical object depending on whether the pad is placed under the base or on top of the cylindrical object. If the cylindrical object is a water heater it may be necessary to cut openings in the bottom pad for the legs or in the top pad for fittings. Since such pads conform in size to the container in which the cylindrical object is to be shipped, it will be seen that the object will be supported against movement within the container by the top and bottom pads.

Figure 5:
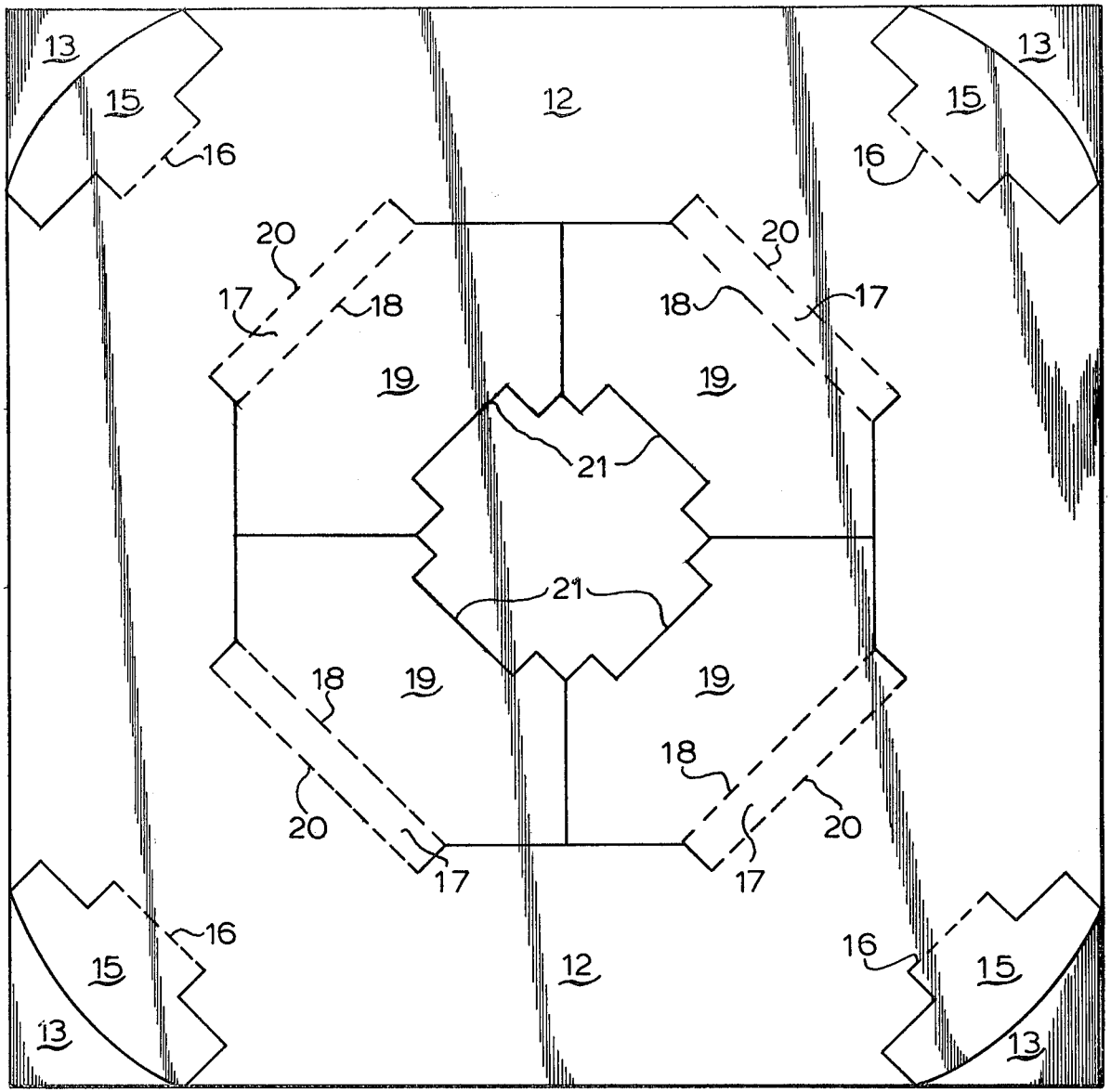
FIG. 5 is a plan view of a blank for a pad for use with an object with a square end.
Figure 6:
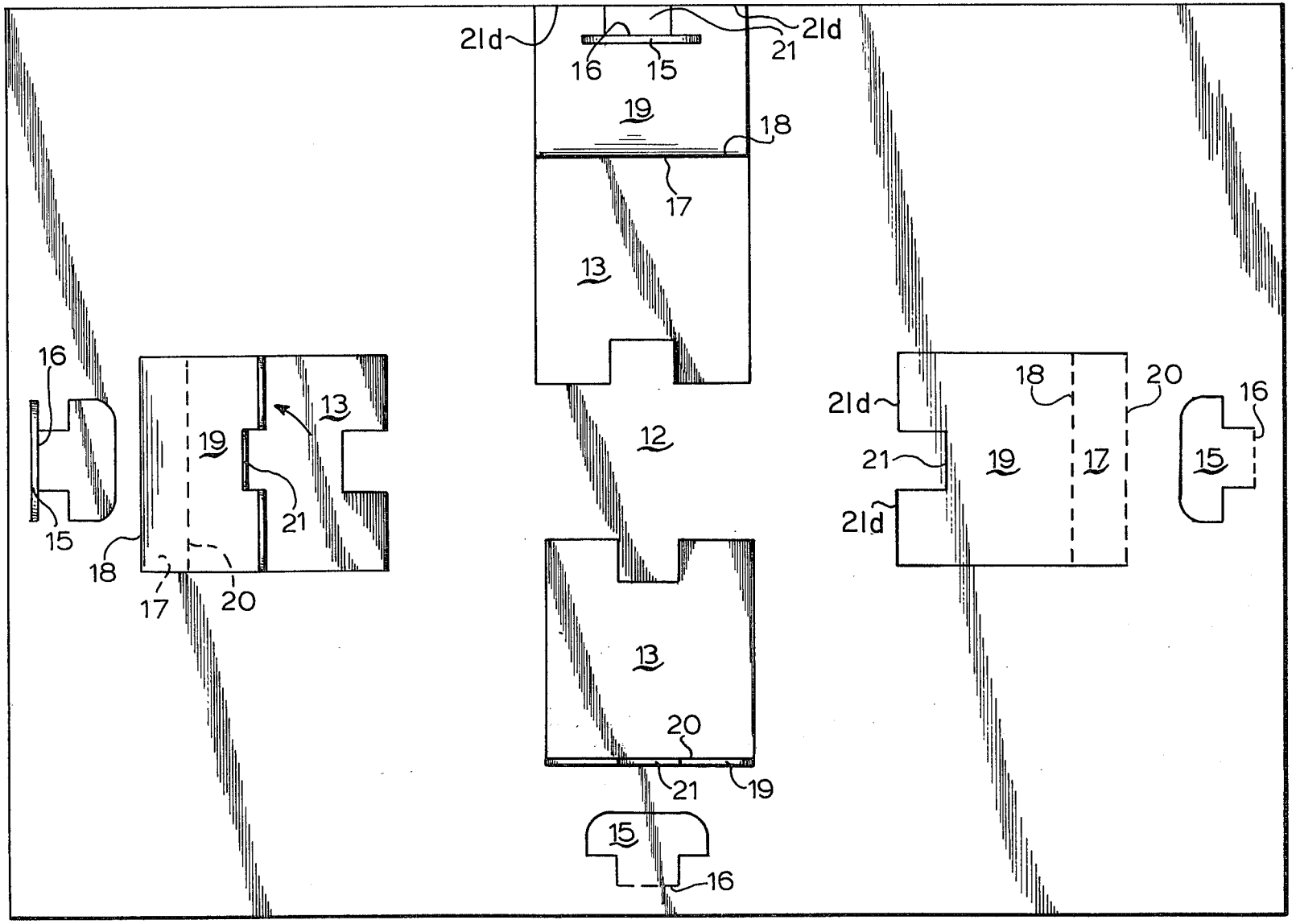
FIG. 6 is a plan view of a blank for a pad for an object with a rectangular end with the stop-support assemblies in various stages of folding, as shown in FIG. 2.

Such stop-support assemblies can be die cut in any position on the die cut panel 12 so that the stops will be located along any contour of the end of the object to be shipped. FIG. 5 illustrates a pad adapted for an object which has a square end. FIG. 6 illustrates a pad adapted for an object which has a rectangular end. The pad of FIG. 6 could likewise be used for an object which has a square end in which case all sides of the rectangle would be equal. The bracing members 19 for the pad of FIG. 6, where such members are to be folded toward a side of the panel rather than a corner, are rectangular in shape. The edges 21*d* of such members will be superimposed over and aligned with the outside edges of the pad panel 12 for further reinforcement as described above.

It thus will be seen that the pad can be used for objects with ends which are cylindrical, square, rectangular and virtually any other shape, i.e., a flattened circle in the form of an ellipse. Although the stop-support assemblies are shown centered on the sides of the square and rectangular ends, it will be understood that they can be located at any position along such side depending on where the support may be needed.

The T-shaped locking member 15 may be on the outside edge of the panel and fold inwardly (FIG. 3) or be placed away from the outside edge of the panel and fold outwardly (FIG. 6). It will be understood that other means such as stapling may be used to secure the bracing member to the die cut panel.

For all of the pads illustrated one panel as shown in FIG. 6, two panels as shown in FIG. 1, or more than two panels may be used, depending on the thickness of pad required, the weight to be supported against movement, the size of the object or other factors. In all cases the die cut panel must be positioned so that the stops come into contact with the top or bottom of the object.

Those skilled in the art will appreciate that many variations of the above described embodiment of the invention may be made without departing from the spirit and scope of the invention.

What is claimed is:

1. A pad to support an object in a shipping container comprising:

a panel, sized substantially the same as the inner dimensions of the said container and positioned to contact an end of said object, being die cut to provide a plurality of spaced stop-support assemblies having stops placed to contact the edge of the said end around its contour;

each said assembly comprising:

a stop hinged to the said panel and folded normal thereto;

a bracing member hinged to and folded outwardly away from the said stop and toward an adjacent edge of the said panel, the said bracing member being shaped and having a width so that at least one edge of the bracing member opposite the stop hinge will be aligned with and superimposed over the adjacent edge of said panel; and means to secure the folded bracing member to the panel;

whereby the bracing member, secured to the panel and reinforced from moving outwardly by at least one inner side of the container, will lock the stop in a position normal to the panel.

2. The pad of claim 1 in which the means to secure the folded bracing member to the panel comprises:

a T-shaped member die cut from and hinged at its base to the panel and adapted to be folded upwardly; and a slot cut in the bracing member in an edge opposite the stop hinge, the width of the slot being approximately equal to the width of the stem of the T of the T-shaped member;

the said slot and T-shaped member being positioned to permit the vertical portion of the T to be inserted in the said slot as the T-shaped member is folded upwardly and hold the said stop normal to the panel.

3. The pad of claim 1 in which the said object has cylindrical ends and the stop-support assemblies are positioned on the panel so that the stops will contact the edge of one of the cylindrical ends.

4. The pad of claim 1 in which the said object has rectangular ends and the stop-support assemblies are positioned on the panel to contact each side edge of one of the rectangular ends.

5. The pad of claim 1 in which a stop-support assembly is positioned in a corner of the panel and the bracing member is shaped to provide two edges opposite the stop hinge set at an angle so that the said edges of the bracing member will be aligned with and superimposed over the edges of the panel which meet in the said corner.

6. A pad to support an object in a shipping container comprising:

a plurality of superimposed panels sized substantially the same as the inner dimensions of the said container;

one of said panels, positioned to contact an end of said object, being die cut to provide a plurality of spaced stop-support assemblies having stops placed to contact the edge of said end around its contour;

each said assembly comprising:

a stop hinged to the die cut panel and folded normal thereto;

a bracing member hinged to and folded outwardly away from the said stop and toward an adjacent edge of the said die cut panel;

the said bracing member being shaped and having a width so that at least one edge of the bracing member opposite the stop hinge will be aligned with and superimposed over the adjacent edge of said die cut panel; and means to secure the folded bracing member to the die cut panel;

whereby the bracing member, secured to the die cut panel and reinforced from moving outwardly by at least one inner side of the container, will lock the stop in a position normal to the die cut panel.

7. A blank for a pad to support an object in a shipping container comprising:

a panel, sized substantially the same as the inner dimensions of the said container and positioned to contact an end of said object, being die cut to provide a plurality of spaced stop-support assemblies which are placed so that the stops when folded normal to the panel will contact the edge of the said end around its contour;

each said assembly comprising:

a stop which is hinged along a second score line to the panel and adapted to be folded normal thereto;

a bracing member which is hinged to the said stop along a first score line parallel to and spaced from the said second score line whereby the bracing member can be folded outwardly away from the said stop when the stop is folded normal to the said panel, the said bracing member being shaped and having a width so that at least one edge of the bracing member opposite the stop hinge, when the bracing member is folded outwardly, will be aligned with and superimposed over the adjacent edge of said panel; and means to secure the bracing member to the panel when the bracing member is folded outwardly away from the said stop;

whereby the bracing member, when folded outwardly and secured to the panel, will be further reinforced from moving outwardly by at least one inner side of the container to thereby lock the stop in a position normal to the panel.

* * * * *